US007422342B2

(12) United States Patent
Nanni et al.

(10) Patent No.: US 7,422,342 B2
(45) Date of Patent: Sep. 9, 2008

(54) FLUID DELIVERY SYSTEM WITH INTEGRATED LIGHT SOURCE

(75) Inventors: Mario Nanni, Faenza (IT); Marco Costanzi, Bentivoglio (IT)

(73) Assignee: Viabizzuno S.r.l., Bentivoglio (IT)

( * ) Notice: Subject to any disclaimer, the term of this patent is extended or adjusted under 35 U.S.C. 154(b) by 36 days.

(21) Appl. No.: 10/541,650

(22) PCT Filed: Dec. 30, 2003

(86) PCT No.: PCT/IB03/06231

§ 371 (c)(1),
(2), (4) Date: Oct. 3, 2006

(87) PCT Pub. No.: WO2004/060570

PCT Pub. Date: Jul. 22, 2004

(65) Prior Publication Data

US 2007/0097665 A1 May 3, 2007

(30) Foreign Application Priority Data

Jan. 7, 2003 (IT) ..... BO2003A0007

(51) Int. Cl.
*B05B 15/00* (2006.01)

(52) U.S. Cl. ..... 362/96; 362/101

(58) Field of Classification Search ..... 362/101, 362/96

See application file for complete search history.

(56) References Cited

U.S. PATENT DOCUMENTS

| | | | | |
|---|---|---|---|---|
| 4,564,889 A | | 1/1986 | Bolson | |
| 5,207,499 A | * | 5/1993 | Vajda et al. | 362/96 |
| 6,021,960 A | * | 2/2000 | Kehat | 239/289 |
| 2002/0158153 A1 | | 10/2002 | Zieger et al. | |
| 2006/0002105 A1 | * | 1/2006 | Hinojosa, Jr. | 362/101 |
| 2007/0097665 A1 | * | 5/2007 | Nanni et al. | 362/96 |

FOREIGN PATENT DOCUMENTS

| | | |
|---|---|---|
| DE | 91 09 457 | 10/1991 |
| JP | 2-307553 | 12/1990 |
| JP | 4-79920 | 3/1992 |
| WO | WO 95/29300 | 11/1995 |

OTHER PUBLICATIONS

Patent Abstracts of Japan, vol. 0150, No. 92, Mar. 6, 1991 corresponding to JP 2-307533.

Patent Abstracts of Japan, corresponding to JP 4-79920.

* cited by examiner

*Primary Examiner*—Anabel M Ton
(74) *Attorney, Agent, or Firm*—Richard M. Goldberg

(57) ABSTRACT

Fluid delivery system, in particular for showers, comprising: a first conduit (22) whose terminal section (20) flows into at least one outlet (26) for the delivery of a fluid jet in a preferential direction; a light source (52); and a second conduit (30) whose terminal section leads into at least a one outlet (28) for the emission of a beam of light produced by the light source (52), and oriented essentially in parallel with the aforementioned preferential direction; characterised in that the terminal sections (20, 30) of the first and second conduits have at least one common wall (32) segregating the beam of light from the fluid, prior to its delivery.

9 Claims, 5 Drawing Sheets

FLUID DELIVERY SYSTEM WITH INTEGRATED LIGHT SOURCE

BACKGROUND OF THE INVENTION

This invention refers to a fluid delivery system, in particular for showers, comprising a first conduit whose terminal section leads to at least one outlet for delivery of a fluid jet in a preferential direction, a light source, and a second conduit terminating in at least one outlet for emission of a beam of light produced by the light source, oriented essentially in parallel with the aforementioned preferential direction.

In certain prior art solutions, illumination of water jets issued from nozzles, taps or shower heads is accomplished by means of light sources located inside the fluid flow. U.S. Pat. No. 4,564,889 describes a solution in which an alternator is installed inside the fluid delivery conduit, and driven directly by the flow of fluid.

The alternator generates the electricity needed to power a light bulb, which illuminates the water that falls upon it. Compared with a mains-electricity powered device, use of an alternator is more prone to malfunctions, so that failures are not only more frequent but often not repaired, due to the difficulty of replacing parts inside the conduit. Considering that, in swimming pools or fountains, large numbers of such devices are commonly used together to create an artistic overall effect, the malfunction of one or more of them will produce the exact opposite of the desired result.

Other solutions illuminate the water indirectly, by transmitting electromagnetic waves from a remote source. The resultant light changes colour depending on properties such as the water temperature or the angle of reflection with which the light impinges on the jet. This is the solution described in international patent application WO9529300, in which a light source is installed behind the delivery head and illuminates the water flowing inside through a glass window, before it comes out in the form of a jet. The glass window is decorated with motifs that create attractive optical effects. The light reaches the exterior through the water outlet holes, which are generally of very small diameter, resulting in poor or insufficient illumination of the area underneath the shower, What is more, the light is partially screened by the water, which absorbs some of the electromagnetic radiation before it can propagate into the target area. The device is also generally quite cumbersome and complicated, due to the number and arrangement of its parts. Suffice it to consider that some embodiments even use systems of mirrors and optical fibres to convey the light onto the fluid, or include mechanisms for modifying the decoration reflected by the light upon the water.

A third category of solutions simply combines a shower head with a light source that is segregated from the diffuser, i.e. the chamber inside the shower head where the water is collected and emitted in the typical rain spray pattern. Japanese patent JP4079920 describes one such device, in which a cylindrical casing is mounted in an inclined position at one end of a rod. The casing has a downward-facing opening which leads into the outlet holes of the diffuser inside. A clear cap at one end of the casing houses a light bulb that illuminates the bathroom whenever somebody walks in. The device is arranged to produce an artistic pattern, and even though the light source is incorporated into the shower head, the resultant illumination is independent of the water jet and evenly distributed throughout the target area.

Ultimately, the main disadvantage of the prior art solutions is that they are designed primarily with an eye to obtain artistic effects from the interplay of light reflected and refracted by the fluid, as well as from the way in which the light and spray diffuser are put together, but do not provide effective and satisfactory illumination of the shower's target area, especially when the water is not flowing. However for residential and commercial sanitary applications, adequate illumination is a primary requirement, both in the case of devices intended to create special aesthetic effects, and in the more common applications involving simple delivery of the water.

SUMMARY OF THE INVENTION

The purpose of this invention is to resolve the shortcomings of the prior art solutions, and more specifically to produce a fluid delivery system, in particular for showers, having an integrated light source capable of effectively and adequately lighting the target area of the fluid jet in question.

An additional purpose of the invention is to produce a fluid delivery system, of the type described above, that is of simple construction, small in size, with a compact and practical shape, and affords ease of maintenance as well as high reliability against possible malfunctions due to the vicinity of electricity and a fluid.

To fulfil the above purposes, this invention consists of a fluid delivery system of the type specified in the preamble to this description, in which the terminal sections of the first and second conduits have at least one common partition segregating the beam of light from the fluid, prior to delivery of the fluid jet.

Under a preferred embodiment, the second conduit, or light emission conduit, is located at least partially inside the first conduit, or fluid delivery conduit, for example running through it centrally, or along one of the walls separating it from the outside environment.

In another preferred embodiment, the light source is installed on the fluid delivery system in a position external to the fluid conduit, thus isolating it from the fluid and avoiding problems arising from the presence of the electrical contacts, and is aligned with the light emission conduit which directs the beam of light onto the target area of the shower jet.

In another preferred embodiment, the ends of the fluid delivery and light emission conduits are aligned with each other on the same wall of the fluid delivery system, thereby ensuring that the fluid jet and beam of light are projected out from their respective conduits onto the same target area. It is possible, for example, for one wall of the fluid delivery conduit to have one or more outlet holes, through which the fluid can respectively be delivered either in a concentrated jet or rain spray pattern, as in the typical case of a shower, and for that same wall to also have at least one outlet for the light, such as an opening or a clear window, through which the light emission conduit communicates optically with the exterior. The walls of the light emission conduit should preferably be tapered toward this light emission outlet, so that the cross-section for passage of the light progressively diminishes as one moves away from the source installed inside the fluid delivery system.

The first advantage of this implementation is that it allows the beam of light exiting the conduit to be directed and/or focused on the same target area toward which the fluid jet is aimed, affording optimal illumination of the persons or objects at that point. The light coming from the emission conduit, which can be of various colours, also passes through the delivered fluid, producing attractive optical effects—especially in the case of water—which are especially desirable in luxury bathroom decorating applications.

A second advantage of a tapered cross-section is that it prevents backflow of fluid along the light emission conduit, in cases where outlet for passage of the light, which is directed toward the target area of the fluid jet, comprises an opening, thereby ensuring that the contacts of the light source installed inside the fluid delivery system remain dry.

The walls of the light emission conduit also serve to completely segregate and seal it from the interior of the fluid delivery conduit. This implementation allows any type of light source to be incorporated into the fluid delivery system, thanks to the excellent isolation afforded by the light emission conduit, permitting considerable savings in space.

In one preferred variant, the light emission conduit has at least one clear wall through which it transmits light outside the fluid delivery system and/or inside the fluid delivery conduit, allowing special lighting effects to be achieved, for example by using coloured decorations on that wall.

Under another particularly advantageous embodiment, the light emission and fluid delivery conduits are housed inside a support, such as a flush-mount box or directional overhead fixture, on which a lamp holder is assembled that provides the necessary connections for the light source. The components of the fluid delivery system are thus few in number and can be easily assembled and disassembled from the support, allowing for quick repairs.

Under another preferred embodiment, the fluid delivery system comprises a main chamber, such as a conduit or a diffuser, provided with one or more openings—for example holes—that taken together form a fluid delivery area. In addition, a light source coupled to this main chamber emits a beam of light that is projected out of the main chamber and originates from a portion of the fluid delivery area in which there are no delivery holes.

In another embodiment the lower portion of the fluid delivery system can be disassembled, to facilitate access to its interior components for cleaning and maintenance.

Naturally, the construction of the fluid delivery system can be adapted to meet requirements of particular installations, as well as to answer specific aesthetic preferences. The fluid delivery system can therefore be constructed and adapted for built-in installation, or for external wall- or ceiling mounted installation. The fluid delivery system, and in particular through not exclusively its lower plate, can be constructed in a number of different shapes, for example round, rectangular, square or variously contoured.

BRIEF DESCRIPTION OF THE DRAWINGS

Additional features and advantages are set forth in the detailed description that follows, which makes reference to the annexed figures (provided purely by way of example and not intended as an exhaustive representation) where.

DETAILED DESCRIPTION

Figure 1:
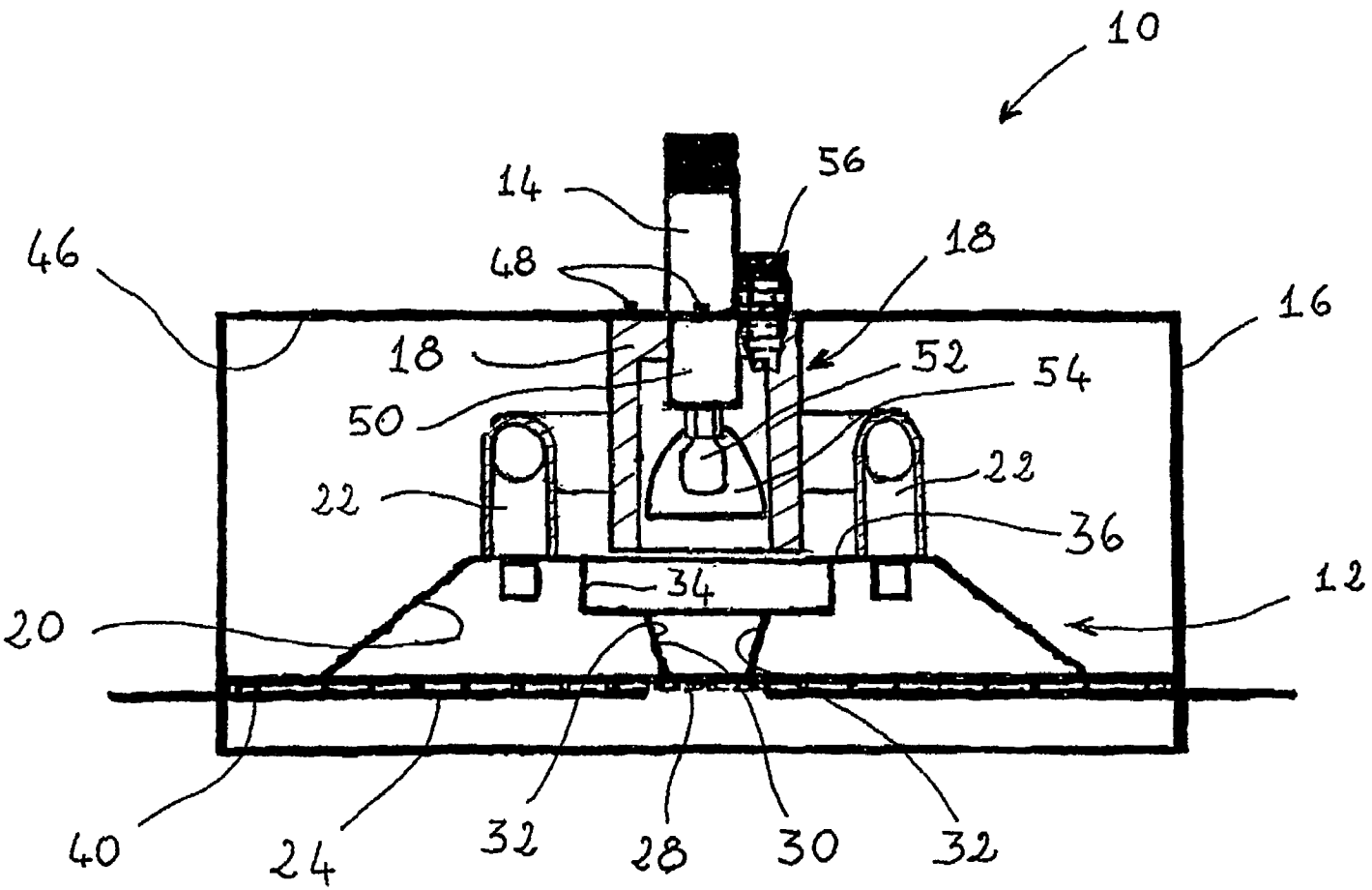
FIG. 1 shows a side cross-sectional view of a fluid delivery system according to this invention.
Figure 2:
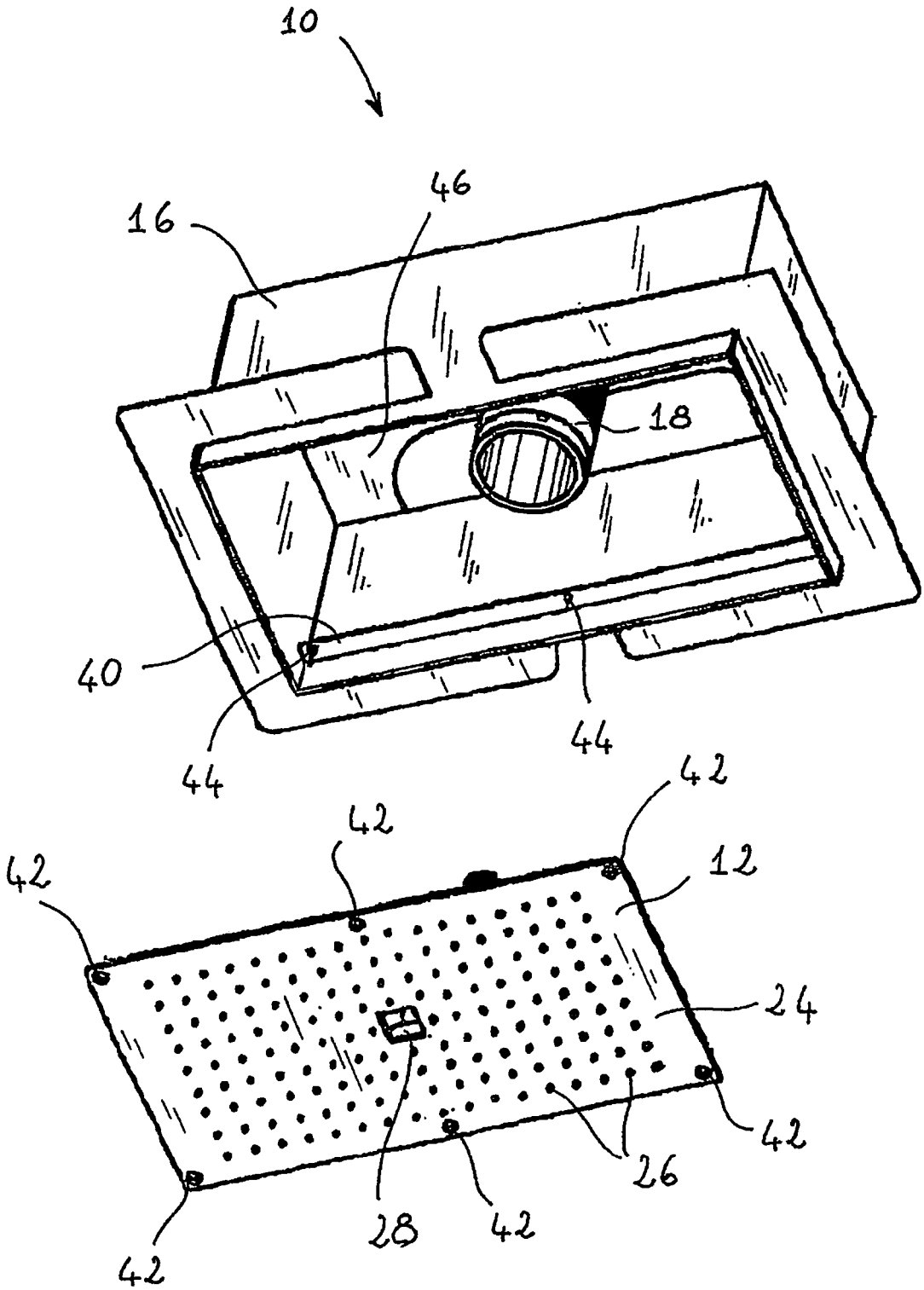
FIG. 2 is an exploded axonometric drawing of the fluid delivery system of FIG. 1.
Figure 3:
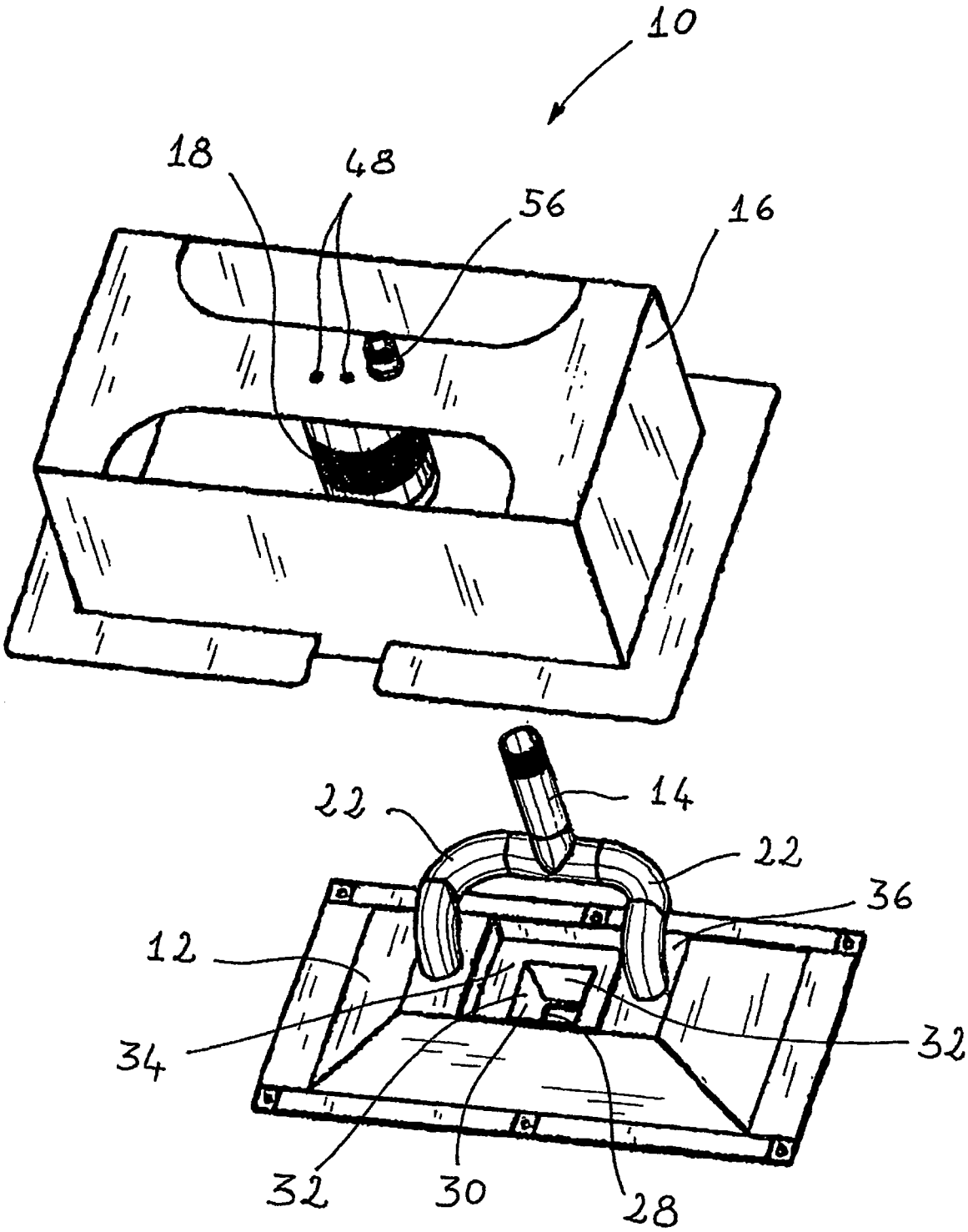
FIG. 3 is an exploded axonometric drawing of the fluid delivery system of FIG. 1, viewed from a different angle than that in FIG. 2.

With reference to FIGS. 1 to 3, a fluid delivery system 10, for example the end section of a shower pipe, a washbasin tap spout, spray gun or the like, comprises a diffuser 12 communicating with a fluid supply conduit 14, connected to the water mains or to a holding tank of fluid, and a support 16 such as a flush-mount box or overhead fixture, on which is assembled a lamp holder 18.

The fluid diffuser 12 comprises a hollow chamber 20 whose cross section is preferably, but not necessarily, greater than that of the supply conduit 14, to which it can be connected, for example, by means of two pipe unions 22. The hollow chamber 20 is delimited at one end by a wall 24 which has a large number of holes 26 that produce a characteristic rain shower spray pattern. A conduit 30 runs preferably but not necessarily, at least partially inside or alongside the hollow chamber 20, from which it is completely segregated by means of waterproof common walls 32. One end of conduit 30 preferably terminates in the middle of wall 24 in an outlet 28 for allowing light to pass through, such as an opening or clear window. The walls 32 extend from the outlet 28 and are angled relative to wall 24, so that the resultant cross section of conduit 30 increases with increasing distance from outlet 28. The walls 32 can be made from a clear or opaque material. At the end opposite to outlet 28, conduit 30 flows into an opening 34 on the rear side 36 of diffuser 12.

The overhead fixture 16 is preferably box shaped with flat and/or curved walls. Inside the fixture are supporting fins 40 for the diffuser 12, which is mounted up against them and secured with screws inserted into the holes 42 on wall 24 and into the holes 44 on fins 40. The lamp holder 18 is mounted on the rear wall 46 inside the overhead fixture—which on assembly faces the rear side 36 of the diffuser 12—for example by means of one or more rivets 48 or other known fixing method. The lamp holder 18 comprises a known connecting system 50 for a lamp 52, such as a screw or bayonet fitting, and a reflector 54 oriented so that the light beam is directed toward the conduit 30. The lamp holder 18 and the conduit 30 are preferably aligned with each other. A cable connector 56 (cables are not illustrated) allows current to pass from the exterior of the fluid delivery system 10 into the lamp holder 18.

When the fluid is flowing, water or some other fluid comes out of the holes 26 in a rain spray pattern, while conduit 30 is kept dry thanks to its recessed position behind wall 24 and the tapered conformation of its walls 32. A beam of light, originating from light source 52 and focused by reflector 54, travels along conduit 30 which keeps it segregated from the water inside the chamber 20, and is then projected out along the same direction as the rain spray pattern. In this way, if the direction of the diffuser spray pattern is changed, by adjusting the angle of the fluid delivery system 10, the light beam will follow the fluid jet and continue to illuminate its target area.

Figure 4:
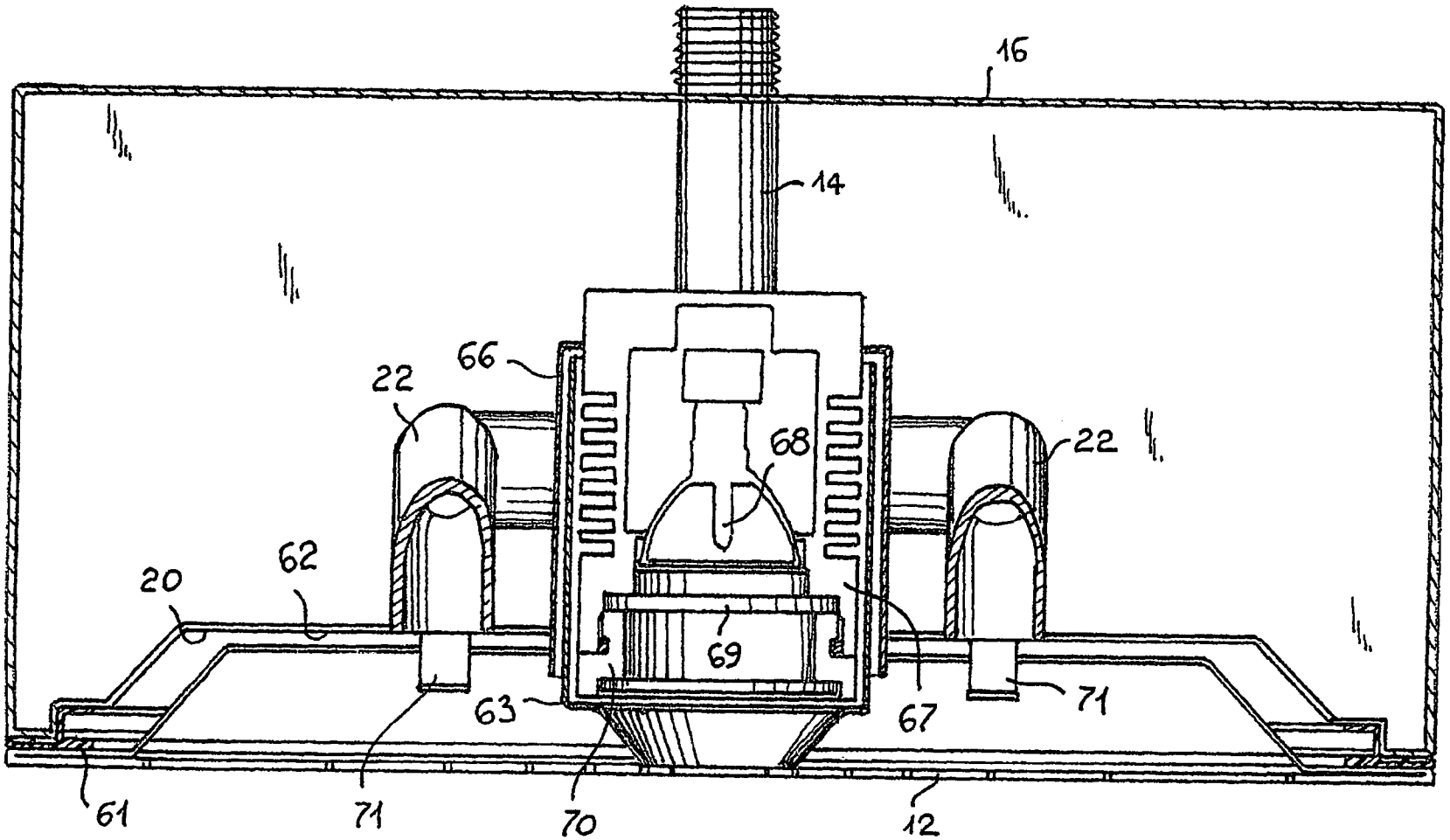
FIG. 4 shows, in cross-section, a variant of the fluid delivery system according to this invention, of the type that can be disassembled
Figure 5:
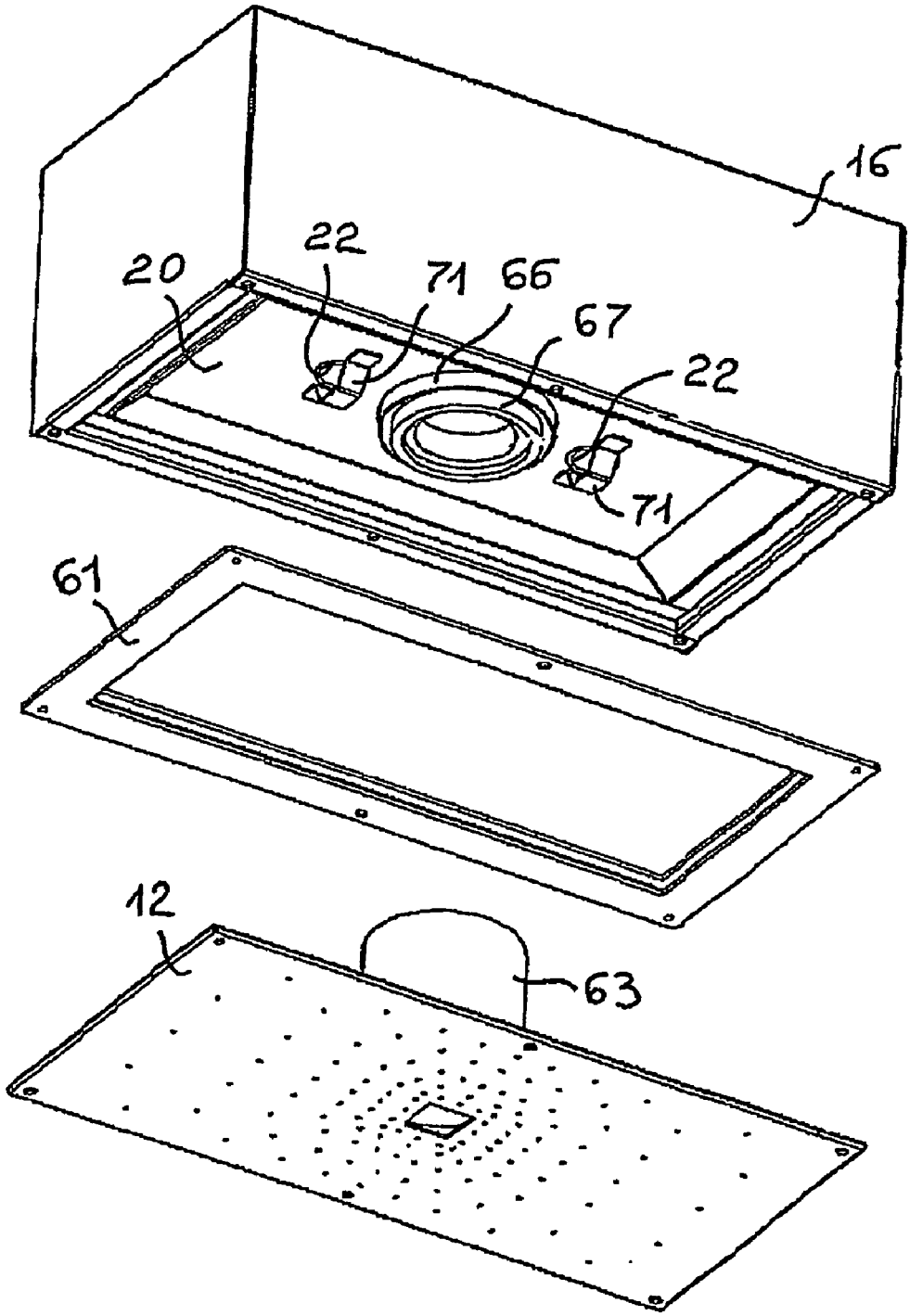
FIG. 5 is an exploded axonometric drawing, similar to that in FIG. 2, of the variant fluid delivery system of FIG. 4.

FIGS. 4 and 5 illustrate a variant of the fluid delivery system according to this invention, in which a removable diffuser 12 is fixed to the lower part of the support 16, closing off a hollow section 62 through the interposition of a seal 61. A first segregating partition 63 extends from the middle of diffuser 12 into support 16, and slots in between a second segregating partition 66, fixed to support 16, and a component 67 that supports and houses a lighting fixture 68, which selectively emits a beam of light in the direction of and beyond diffuser 12 as described previously. In a preferred—though not the only—solution a clear or translucent divider 69 is placed between the lighting fixture 68 and the light emission outlet on diffuser 12, and fixed to the support and housing element 67 by means of a locking ring 70 or other similar or known methods.

The fluid delivery conduit 14 is split, as described previously, into pipe unions 22 which lead into the chamber 20 of diffuser 12, and from there to flow restrictor elements 71.

One of the advantages of a fluid delivery system according to this invention is that the illumination is independent of the supply of the water jet, and can therefore be retained even when the water is shut off. When the water is flowing, the illumination of the target area is brighter and more uniform than that achieved when the light transmitted out from the delivery head must pass through the water.

The above-described fluid delivery system, in addition to providing effective illumination, creates attractive effects due to reflection and refraction of the light in the target area of the fluid jet, making it ideal both for bathroom sanitary applications and artistic lighting systems.

Another especially advantageous feature, which arises in the case of swivel delivery systems, is that the beam of light can follow the flow of fluid, projecting maximum light intensity on the target area irrespective of changes in its position.

Naturally, and without prejudice to the principle of the invention, the construction characteristics and implementation details can vary widely from those described and illustrated here, without for this reason falling outside the scope of the present invention.

What is claimed is:

1. Fluid delivery system for showers, comprising:

a diffuser having a first conduit with a terminal section that flows into at least one opening provided on the diffuser, for the delivery of a fluid jet in a preferential direction;

a flush-mount box support on which is mounted a light source; and a second conduit provided on the diffuser, with a terminal section that leads into at least one outlet for emission of a beam of light produced by the light source and oriented essentially in parallel with the aforementioned preferential direction; and the terminal sections of the first and second conduits having at least one common wall which segregates the light beam from the fluid prior to delivery of the fluid jet;

wherein said diffuser is entirely contained inside the overall dimension of the flush-mount box support.

2. Fluid delivery system according to claim 1, wherein the second conduit runs at least partially inside the first conduit.

3. Fluid delivery system according to claim 2, wherein the light source is external to the first conduit and isolated from the fluid.

4. Fluid delivery system according to claim 1, wherein the at least one opening for the delivery of the fluid jet and the at least one opening for the emission of the beam of light are aligned on a same wall of the fluid delivery system.

5. Fluid delivery system according to claim 4, wherein the light source is mounted in alignment with the second conduit.

6. Fluid delivery system according to claim 5, wherein the second conduit is tapered and a cross-section of the tapered second conduit decreases in size in a direction moving away from an interior thereof and towards the at least one opening for the emission of light.

7. Fluid delivery system according to claim 6, wherein the second conduit is delimited by waterproof walls which completely seal and segregate the second conduit from an interior of the first conduit.

8. Fluid delivery system according to claim 7, wherein the second conduit has at least one transparent wall.

9. Fluid delivery system according to claim 1, wherein the support is equipped with a fitting for the light source.

* * * * *